US005221303A

United States Patent [19]

Gühne et al.

[11] Patent Number: 5,221,303

[45] Date of Patent: Jun. 22, 1993

[54] INTERFACE ARRANGEMENT FOR A FILTER BAG IN A VACUUM CLEANER

[75] Inventors: Wieland Gühne, Reimscheid; Heinz-Jürgen Ahlf, Bergisch Gladbach, both of Fed. Rep. of Germany

[73] Assignee: Vorwerk & Co. Interholding GmbH, Wuppertal, Fed. Rep. of Germany

[21] Appl. No.: 923,580

[22] Filed: Aug. 3, 1992

[30] Foreign Application Priority Data

Aug. 1, 1991 [DE] Fed. Rep. of Germany ... 9109522[U]

[51] Int. Cl.[5] ..... B01D 46/00

[52] U.S. Cl. ..... 55/367; 15/352; 55/373; 55/378; 55/DIG. 2

[58] Field of Search ..... 55/367, 373–378, 55/DIG. 2; 15/352

[56] References Cited

U.S. PATENT DOCUMENTS 4,851,019 7/1989 Ahlf et al. ..... 55/367

*Primary Examiner*—Charles Hart

*Attorney, Agent, or Firm*—Walter Ottesen

[57] ABSTRACT

The invention relates to an electric vacuum cleaner having a filter bag intermediate carrier disposed between a filter cassette arranged above a motor-driven blower and the motor housing. The intermediate carrier is pivotally mounted via a hinge and has guide cams which dip into engaging recesses of a base plate of the filter bag. The vacuum cleaner apparatus can only be operated with filter bags which are specific to this apparatus. Safety cams are formed on the intermediate carrier and follow the inner wall surface of the filter cassette when the intermediate carrier is closed. Catches are formed on the inner wall surface but do not catch the safety cams if an authorized filter bag is placed in the filter cassette. However, if an unauthorized filter bag is placed in the filter cassette, then the structure of this filter bag causes the safety cams to deflect and catch in the catches thereby preventing the operator from completely closing the intermediate carrier on the filter cassette.

4 Claims, 2 Drawing Sheets

INTERFACE ARRANGEMENT FOR A FILTER BAG IN A VACUUM CLEANER

FIELD OF THE INVENTION

The invention relates to an interface arrangement for a filter bag disposed between a filter cassette arranged above the blower of a vacuum cleaner and the motor housing of the vacuum cleaner. An intermediate carrier for the filter bag is pivotable via a hinge and has guide cams which dip into recesses of a base plate of a filter bag.

BACKGROUND OF THE INVENTION

Up until now, and as shown in U.S. Pat. No. 4,851,019, two guide cams dip into the engaging recesses of the base plate of a filter bag when the intermediate carrier for the filter bag is closed. In this way, it is ensured that the stub mounted on the intermediate carrier dips centrally into the filter bag. However, the guide cams alone cannot prevent filter bags from being used which are not designed specifically for the apparatus; that is, filter bags which do not have engaging recesses through which the guide cams can slide.

Resistance is offered to the guide cams by a base plate of an unauthorized filter bag which does not have the engaging recesses. This resistance can be overcome by the application of intense pressure when closing the filter cassette.

In this way, the vacuum cleaner can be operated with filter bags which are mounted incorrectly because they are not designed specifically for the apparatus.

This causes the filter bags to be improperly filled which means that more filter bags are needed over an extended period of time than would be the case where there is an optimal filling of the filter bags specific to the apparatus.

This leads to a greater burden to the environment and is of greater monetary cost to the consumer.

In addition, dust can reach the ambient in the case of a poorly seated filter bag and this disables special filters for filtering the fine dust and has negative health consequences for the operator and especially an operator allergic to household dust.

SUMMARY OF THE INVENTION

It is an object of the invention to ensure that the vacuum cleaner will not be utilized with filter bags which cause the above-mentioned disadvantages.

The advantage of the interface arrangement of the invention is especially seen in that the electric vacuum cleaner cannot be operated with a filter bag which is not specific to the vacuum cleaner because, in this case, the filter cassette cannot be properly latched with the motor housing. Because of the interface arrangement of the invention, filter bags not specific to the vacuum cleaner (that is, unauthorized filter bags) cannot be filled in a disadvantageous manner nor can the operator of the vacuum cleaner be endangered by dust emanating from the vacuum cleaner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
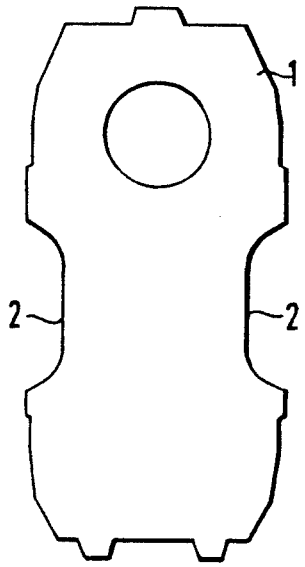
FIG. 1 is a plan view of a base plate of a filter bag specific to the vacuum cleaner apparatus.

When the intermediate carrier 5 is closed on the filter cassette 4, guide cams 6 and the safety cams 7 pass through the engaging recesses 2 of the base plate 1 of the filter bag 3 of FIG. 1 which is specific to the vacuum cleaner apparatus. The catches 8 in the filter cassette 4 remain empty.

Figure 2:
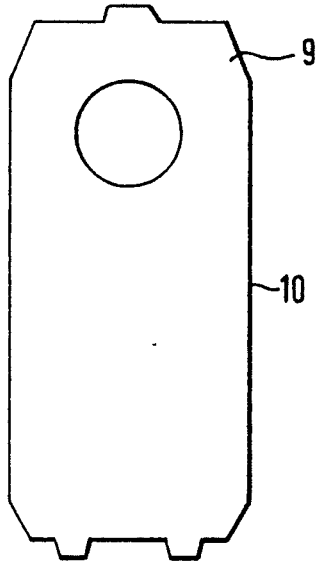
FIG. 2 is a plan view of a base plate of a filter bag which is so configured that it is not specific to the vacuum cleaner apparatus.
Figure 3:
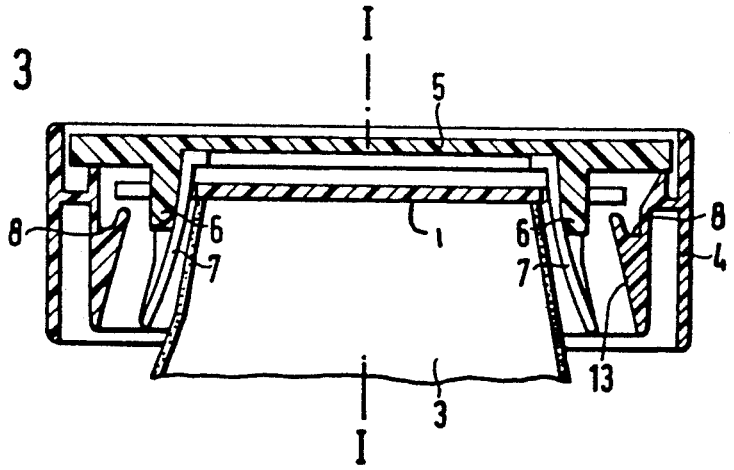
FIG. 3 is a side elevation view, in section, of the filter cassette with a filter bag mounted therein specific to the vacuum cleaner apparatus.
Figure 4:
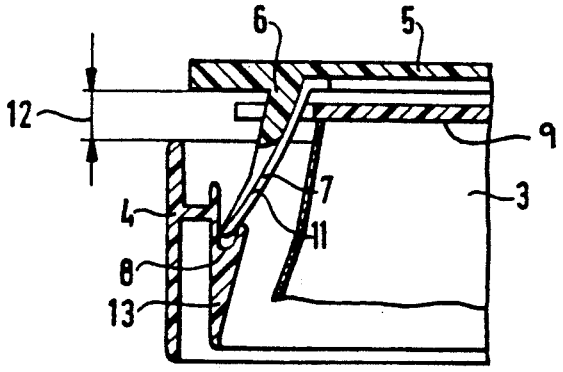
FIG. 4 is a view corresponding to FIG. 3 wherein a filter bag has been inserted which is not specific to the vacuum cleaner apparatus; and, FIG. 5 is side elevation view showing a guide cam and a safety cam of the intermediate carrier.
Figure 5:
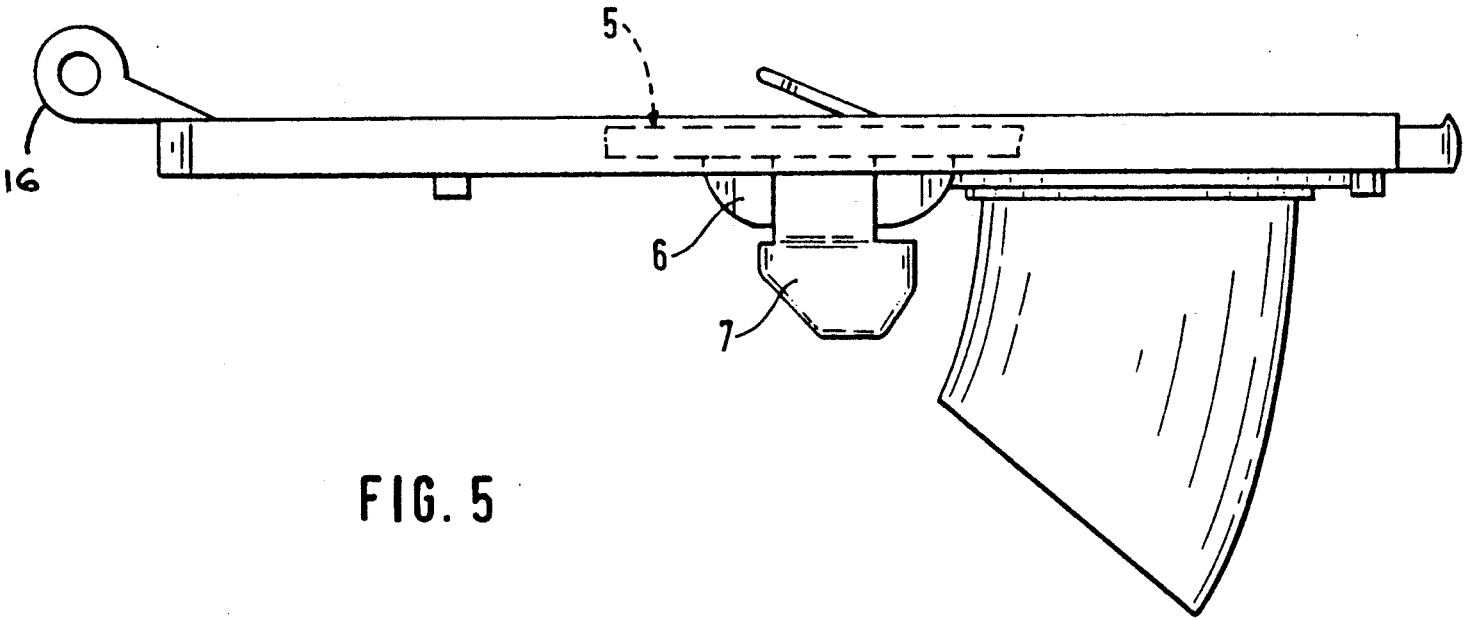

However, if a filter bag 3 is inserted having a base plate 9 as shown in FIG. 2 and having the solid wall 10 (no lateral recesses), then the safety cams made of elastic material are pressed and deflect elastically in the direction of the wall 13 of the filter cassette 4. Accordingly, the safety cams 11 slide into the catches 8. In this way, the intermediate carrier 5 can be pivoted via a hinge 16 (FIG. 5) only up to a distance 12 on the filter cassette 4.

The filter cassette 4 cannot be latched to the motor housing and the vacuum cleaner cannot be operated.

It is understood that the foregoing description is that of the preferred embodiments of the invention and that various changes and modifications may be made thereto without departing from the spirit and scope of the invention as defined in the appended claims.

What is claimed is:

1. In an electric vacuum cleaner having a motor housing, a motor-driven blower and a filter cassette arranged above the motor-driven blower, the filter cassette having an inner wall surface and being adapted to accommodate an authorized filter bag having a base plate, an intermediate carrier connected to said motor housing for closing the filter cassette and an interface arrangement for accepting the authorized filter bag and for not accepting an unauthorized filter bag, the interface arrangement comprising:

said intermediate carrier having a lower side facing toward the filter bag;

engaging recess means formed in said base plate of the authorized filter bag;

safety cams formed on said lower side of said intermediate carrier for passing through said recess means when said intermediate carrier is closed on said filter cassette;

said safety cams engaging the structure of the unauthorized filter bag and being displaceable by said structure toward said inner wall when said intermediate carrier is closed on the unauthorized filter bag; and, catch means formed on said inner wall surface for catching said safety cams when said unauthorized filter bag is placed in said filter cassette and said intermediate carrier is closed thereupon thereby preventing said intermediate carrier from closing the filter cassette.

2. The interface arrangement of claim 1, wherein the unauthorized filter bag has a base wall defining an uninterrupted side wall; and, said structure being said side wall.

3. The interface arrangement of claim 2, said safety cams being made of elastic material.

4. The interface arrangement of claim 1, wherein said catch means is formed on said cassette wall so as to be an integral part thereof.

* * * * *